US008368625B2

(12) United States Patent
Hsu et al.

(10) Patent No.: US 8,368,625 B2
(45) Date of Patent: Feb. 5, 2013

(54) ACTIVE MATRIX DISPLAY DEVICE WITH DUMMY DATA LINES

(75) Inventors: Chih-Chieh Hsu, Miao-Li (TW); Tsau-Hua Hsieh, Miao-Li (TW); Chao-Yi Hung, Miao-Li (TW); Chao-Chih Lai, Miao-Li (TW)

(73) Assignee: Chimei InnoLux Corporation, Miaoli County (TW)

( * ) Notice: Subject to any disclaimer, the term of this patent is extended or adjusted under 35 U.S.C. 154(b) by 961 days.

(21) Appl. No.: 12/386,605

(22) Filed: Apr. 20, 2009

(65) Prior Publication Data

US 2009/0262054 A1 Oct. 22, 2009

(30) Foreign Application Priority Data

Apr. 18, 2008 (CN) ..... 2008 1 0066748

(51) Int. Cl.
*G09G 3/36* (2006.01)

(52) U.S. Cl. ..... 345/87; 345/691

(58) Field of Classification Search ..... 345/39, 345/87, 92, 691; 349/39, 141
See application file for complete search history.

(56) References Cited

U.S. PATENT DOCUMENTS

| | | | | |
|---|---|---|---|---|
| 5,408,252 | A | 4/1995 | Oki et al. | |
| 6,552,707 | B1 * | 4/2003 | Fujiyoshi | 345/98 |
| 6,859,195 | B2 * | 2/2005 | Kodate | 345/92 |
| 2002/0109652 | A1 * | 8/2002 | Lim et al. | 345/87 |
| 2005/0248693 | A1 * | 11/2005 | Kurasawa | 349/39 |

* cited by examiner

*Primary Examiner* — Quan-Zhen Wang
*Assistant Examiner* — Yuk Chow
(74) *Attorney, Agent, or Firm* — Li & Cai Intellectual Property (USA) Office

(57) ABSTRACT

An exemplary active matrix display device includes a display panel comprising a plurality of scanning lines extending along a horizontal axis, a plurality of data lines extending along a vertical axis, and a plurality of dummy data lines. Two scanning lines and two data lines define two display pixels; each of the plurality of data lines is connected to at least two adjacent display pixels along the horizontal axis, and the at least two adjacent display pixels are driven by the two scanning lines, respectively. Each of the plurality of dummy data lines is disposed between two random adjacent data lines and is provided with gray scale voltage signals by a driving circuit of the display panel, thereby forming coupling capacitances between each of the plurality of dummy data lines and two pixel electrodes of the two display pixels.

13 Claims, 6 Drawing Sheets

ACTIVE MATRIX DISPLAY DEVICE WITH DUMMY DATA LINES

BACKGROUND

1. Technical Field

The present disclosure relates to active matrix devices, and more particularly to a liquid crystal display (LCD) device with dummy data lines supplied with gray scale voltages.

2. Description of Related Art

Because LCD devices have the advantages of portability, low power consumption, and low radiation, they have been widely used in various portable information products. Resolution of an LCD device is indicated by a number combination, such as 480×272 for a 4.3-inch LCD device, expressed in terms of the number of pixels on the horizontal axis and the number on the vertical axis. Furthermore, as each pixel is composed of R, G, and B sub-pixels, and each sub pixel is electrically connected to a data line, a total of 272 scanning lines extend along the horizontal axis and 480×3 data lines extend along the vertical axis for the 4.3-inch LCD device. In order to reduce costs and the number of driving ICs, half-data line design has been developed.

Referring to FIG. 7, a partial circuit diagram of a typical active matrix display device is shown. The active matrix display device 1 includes a scanning driving circuit 11, a data driving circuit 12, and a display panel 13. The display panel 13 includes a plurality of parallel scan lines $G_{a1} \ldots G_{am}$ ($m \geqq 1$, where m is an integer) connected to the scanning driving circuit 11, a plurality of parallel data lines $D_{r1} \ldots D_{rn}$ ($n \geqq 1$, where n is an integer) perpendicular to the plurality of scan lines and connected to the data driving circuit 12, a plurality of pixel electrodes $E_{ij}$ ($i,j \geqq 1$, where i and j are integers), and a plurality of thin film transistors (TFTs) 14 functioning as switch elements for driving the pixel electrodes $E_{ij}$.

Two scanning lines $G_{a(2p+1)}$, $G_{a(2p+2)}$ ($m \geqq p \geqq 0$, where p is an integer) and two data lines $D_{rq}$, $D_{r(q+1)}$ ($n \geqq q \geqq 1$, where q is an integer) cooperatively define two display pixels. The two scanning lines $G_{a(2p+1)}$, $G_{a(2p+2)}$ and n columns of data lines $D_{r1} \ldots D_{rn}$ drive j pixel electrodes in one row. One data line $D_{rn}$ is connected to two display pixels adjacent to each other along the horizontal axis, and each two adjacent display pixels are driven respectively by the two scanning lines $G_{a(2p+1)}$, $G_{a(2p+2)}$, that is, source electrodes 141 of the two adjacent TFTs 14 are connected to one data line $D_{rn}$, and gate electrodes 140 of the two adjacent TFTs 14 are separately connected to the two adjacent scanning lines $G_{a(2p+1)}$, $G_{a(2p+2)}$. For example, when p=0, q=1, the gate electrode 140 of TFT 14 will be connected to the scanning line $G_{a1}$, a source electrode 141 is connected to the data line $D_{r1}$, and a drain electrode 142 is connected to the pixel electrode $E_{11}$. Pixel electrode $E_{12}$ is connected to the same data line $D_{r1}$, while the gate electrode 140 of the adjacent TFT 14 is connected to the scanning line $G_{a2}$. That is, the data line $D_{r1}$ supplies the two pixel electrodes $E_{11}$, $E_{12}$ with gray voltages, as shown in FIG. 7.

Referring also to FIG. 8, an enlarged view of part of the active matrix display device 1 of FIG. 7 is shown. A distance and a coupling capacitance (not shown) between the data line $D_{r1}$ and the pixel electrode $E_{12}$ are separately represented as $d_1$ and Csp1. A distance and a coupling capacitance (not shown) between data line $D_{r2}$ and the pixel electrode $E_{13}$ are separately represented as $d_2$ and Csp2. A distance and a coupling capacitance (not shown) between the pixel electrode $E_{12}$ and the pixel electrode $E_{13}$ are separately represented as $d_3$ and Csp3.

During operation, when scanning signals are applied to the plurality of scanning lines $G_{a1} \ldots G_{am}$ in sequence, the data lines $D_{r1} \ldots D_{rn}$ provide gray scale voltages for the pixel electrodes simultaneously. When p=0, for example, if the scanning signal is applied to the scanning line Gal, the TFT 14 connected to the scanning line $G_{a1}$ is turned on. Consequently, the odd pixel electrodes $E_{11}$, $E_{13}$, $E_{15} \ldots$ are written into gray scale voltages to display corresponding gray scales. When the scanning signal is applied to the scanning line $G_{a2}$, the TFT 14 connected to the scanning line $G_{a2}$ is turned on. Consequently, the even pixel electrodes $E_{12}$, $E_{14}$, $E_{16} \ldots$ are written into gray scale voltages to display corresponding gray scales. The pixel electrodes $E_{2j}$ display gray scale in the same driving method: in the first period, the odd pixel electrodes $E_{21}$, $E_{23}$, $E_{25} \ldots$ are written into gray scale voltages to display corresponding gray scale, in the following period, the even pixel electrodes $E_{22}$, $E_{24}$, $E_{26} \ldots$ are written into gray scale voltages to display corresponding gray scales. The above-mentioned driving method is repeated in the next frame.

During manufacture of such an active matrix display device, exposure shift or uneven etching maybe occur due to limited precision of the manufacturing device. As a result, the differences among the distances $d_1$, $d_2$ and $d_3$ increase. While capacitance is inversely related to the distance, half-data line design increases differences among the capacitances Csp1, Csp2 and Csp3. Consequently, the voltage difference between the adjacent pixels $E_{ij}$ and common electrode (not shown) also increases. Thus, flickering may occur, affecting display quality.

What is needed, therefore, is an active matrix display device to overcome the described limitations.

DETAILED DESCRIPTION

References will now be made to the drawings to describe exemplary embodiments of the present disclosure in detail.

Figure 1:
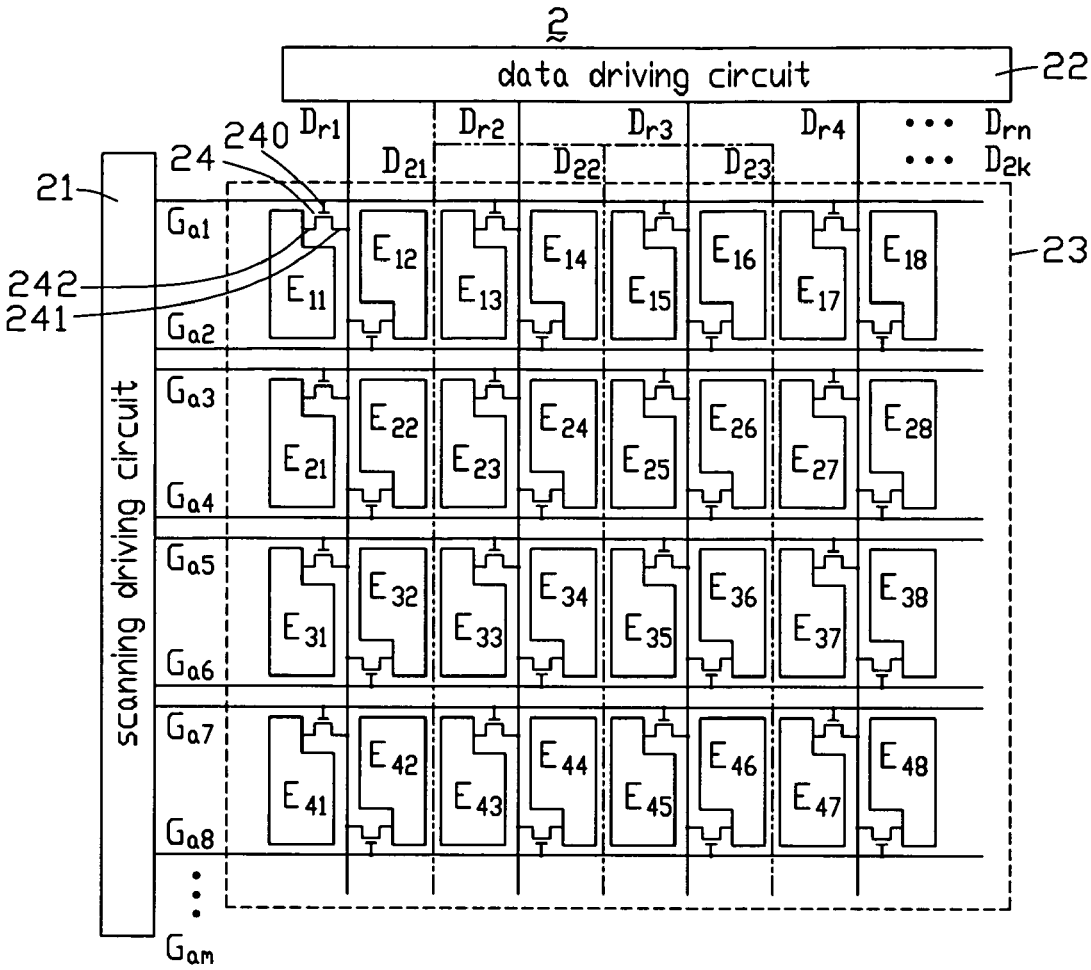
FIG. 1 is a partial circuit diagram of a first embodiment of an active matrix display device according to the disclosure.

FIG. 1 is a partial circuit diagram of a first embodiment of an active matrix display device according to the present disclosure. The active matrix display device 2 includes a scanning driving circuit 21, a data driving circuit 22, and a display panel 23.

The display panel 23 includes m rows of parallel scanning lines $G_{a1} \ldots G_{am}$ ($m \geqq 1$, where m is an integer) connected to the scanning driving circuit 21, n columns of parallel data lines $D_{r1} \ldots D_{rn}$ ($n \geqq 1$, where n is an integer) connected to the data driving circuit 22, a plurality of TFTs 24, a plurality of pixel electrodes $E_{ij}$ (i, j≧1, where i and j are integers), and a plurality of dummy data lines $D_{21} \ldots D_{2k}$ (k≧1, where k is an integer).

The scanning lines $G_{a1} \ldots G_{am}$ extend along the horizontal axis, while the data lines $D_{r1} \ldots D_{rn}$ perpendicularly intersect with the scanning lines $G_{a1} \ldots G_{am}$.

Two scanning lines $G_{a(2p+1)}$, $G_{a(2p+2)}$ (m≧p≧0, where p is an integer) and two data lines $D_{rq}$, $D_{r(q+1)}$ (n≧q≧1, where q is an integer) cooperatively define two display pixels. Each TFT 24 functions as a switch element to drive the pixel electrode $E_{ij}$ to which the TFT 24 electrically connected. The two scanning lines $G_{a(2p+1)}$, $G_{a(2p+2)}$ and n columns of data lines $D_{r1} \ldots D_{rn}$ drive j pixel electrodes in the horizontal axis. Each data line $D_{rn}$ is connected to two adjacent TFTs 24, and gate electrodes 240 of the two adjacent TFTs 24 are separately connected to the two scanning lines $G_{a(2p+1)}$, $G_{a(2p+2)}$. For example, when p=0, q=1, a gate electrode 240 of TFT 24 is connected to the scanning $G_{a1}$, a source electrode 241 is connected to the data line $D_{r1}$, and a drain electrode 242 is connected to the pixel electrode $E_{11}$. Pixel electrode $E_{12}$ is connected to the data line $D_{r1}$ in the same way, while the gate electrode 240 of TFT 24 is connected to the scanning line $G_{a2}$. That's to say, when p=0, the data line $D_{r1}$ supplies the two adjacent pixel electrodes $E_{11}$, $E_{12}$ with gray voltages, as shown in FIG. 1.

The dummy data lines $D_{21} \ldots D_{2k}$ intersect perpendicularly and are insulated from the scanning lines $G_{a1} \ldots G_{am}$. The dummy data line $D_{21}$ is electrically connected to the data driving circuit 22. The rest of the dummy data lines $D_{22} \ldots D_{2k}$ whose ends neighbor the data driving circuit 22 are jointly connected to the dummy data line $D_{21}$. Each of the plurality of dummy data lines $D_{21} \ldots D_{2k}$ is disposed between two adjacent display pixels located between two random adjacent data lines $D_{rn}$.

The gray scale voltages applied to each two adjacent data lines are different from that applied to the dummy data line $D_{rk}$ located between the two adjacent data lines. In operation, a value V of gray scale voltage applied to the dummy data lines can be half gray scale voltage. The pixel value can be 127 for an 8-bit panel for example. That is to say, the pixel value according to a black image is 0, when the voltage between the pixel electrode $E_{ij}$ and the common electrode (not shown) is maximal, represented as $V_{max}$; while the pixel value according to a white image is 255, when the voltage between the pixel electrode $E_{ij}$ and the common electrode is minimal, represented as $V_{min}$. Therefore, the relationship among V, $V_{max}$, and $V_{min.}$ is $V=(V_{max.}+V_{min.})/2$. A driving method of dot inversion for the active matrix display device 2 follows.

Figure 2:
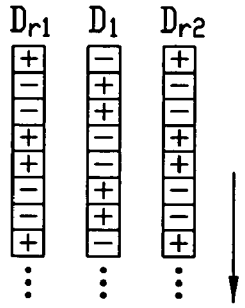
FIG. 2 is a partial schematic view of the active matrix display device of FIG. 1 adopting a driving method of dot inversion.

Referring to FIG. 2, when the scanning line $G_{a1}$ is selected, the TFT 24 connected to the scanning line $G_{a1}$ is turned on, and a positive gray scale voltage is written into the pixel electrode $E_{11}$ by the data line $D_{r1}$. Meanwhile, the positive gray scale voltage is written into the pixel electrode $E_{13}$ by the data line $D_{r2}$. While the dummy data line $D_{21}$ between the two adjacent data lines $D_{r1}$, $D_{r2}$ is applied with voltage V by the data driving circuit 22 at the same time, polarity of the voltage V is different from that applied to the two adjacent data lines $D_{r1}$, $D_{r2}$.

In the subsequent period, the scanning line $G_{a2}$ is selected, the TFT 24 connected to the scanning line $G_{a2}$ is turned on, and a negative gray scale voltage is written into the pixel electrode $E_{12}$ by the data line $D_{r1}$. Meanwhile, the negative gray scale voltage is written into the pixel electrode $E_{14}$ by the data line $D_{r2}$. The value of voltage V applied to the dummy data line $D_{21}$ is still equal to $(V_{max}+V_{min})/2$ at the same time, while now the polarity is inverse.

When the scanning line $G_{a3}$ is selected, the polarity of gray scale voltage supplied by the data lines $D_{r1}$, $D_{r2}$ is negative. The value of voltage V applied to the dummy data line $D_{21}$ keeps unchangeably, and its polarity is positive. When the scanning line $G_{a4}$ is selected, the polarity of gray scale voltages supplied by the data lines $D_{r1}$, $D_{r2}$ is positive. Meanwhile, the value of voltage V applied to the dummy data line $D_{21}$ remains unchanged, while the polarity is inverse at the moment.

The driving method of the pixel electrode $E_{3j}$ is the same as that of the pixel electrode $E_{1j}$, and the driving method of the pixel electrodes $E_{4j}$ is the same as that of the pixel electrodes $E_{2j}$. In a word, for the display panel 23, the driving method of odd pixel electrodes $E_{ij}$ are same, and the driving method of even pixel electrodes $E_{ij}$ are same.

Each of the plurality of dummy data lines $D_{21} \ldots D_{2k}$ is disposed between two display pixels, which are located between the two random adjacent data lines $D_{rn}$, and at the same time, the dummy data line $D_{2k}$ is provided with half gray scale voltage V, equal to $(V_{max}+V_{min})/2$. Thereby, for a single pixel electrode $E_{ij}$, the difference between gray scale voltage applied to one adjacent data line $D_{rn}$ and that applied to the adjacent dummy data line becomes smaller. As a result, difference in the coupling capacitance between them also becomes smaller. It is preferable for the display effect that the gray scale voltage difference between two adjacent pixel electrodes. $E_{ij}$ gets smaller.

Furthermore, the polarity of voltage of the dummy data line $D_{2k}$ is different from that of the two adjacent data lines $D_{rq}$, $D_{r(q+1)}$. The gray scale voltage alternates in polarity from positive to negative for the data lines $D_{rn}$, which are connected to the pixel electrodes $E_{ij}$, while the gray scale voltage alternates in polarity from negative to positive for the dummy data lines $D_{rk}$ at the same time. The opposite effect of coupling capacitance at the two sides of the pixel electrodes $E_{ij}$ further reduces the difference of the two sides coupling capacitance. Thereby, it is significant that the display effect is further improved.

Figure 3:
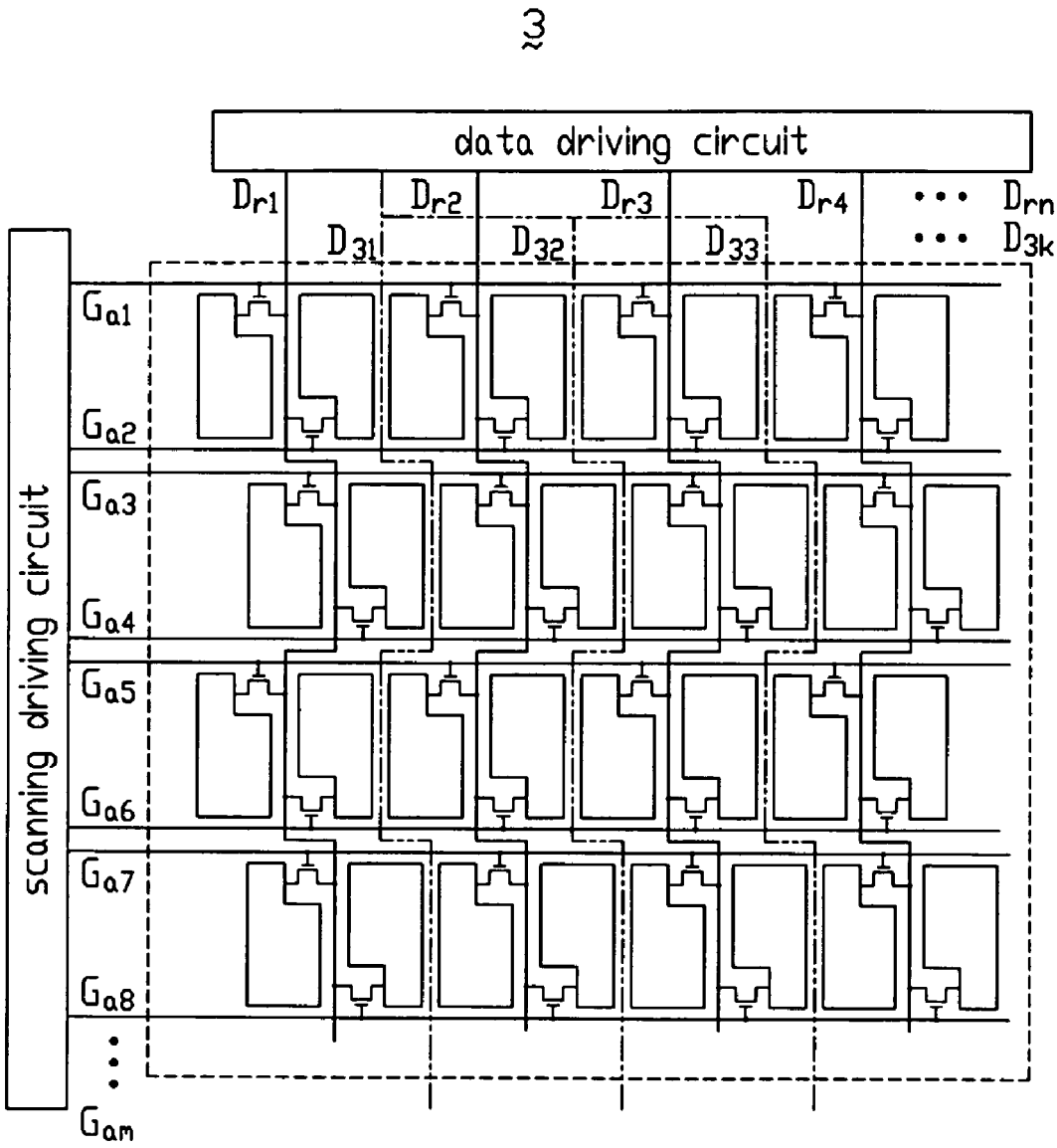
FIG. 3 is a partial circuit diagram of a second embodiment of an active matrix display device according to the disclosure.

Referring to FIG. 3, a second embodiment of an active matrix display device 3 according to the present disclosure differs from the active matrix display device 2 of the first embodiment only in that a plurality of pixel electrodes $E_{ij}$ are arranged in a delta-like pattern. A plurality of data lines $D_{r1} \ldots D_{rn}$ are arranged in square waveforms along the vertical axis, and a plurality of dummy data lines $D_{31} \ldots D_{3k}$ are similarly arranged on the display panel (not labeled).

Figure 4:
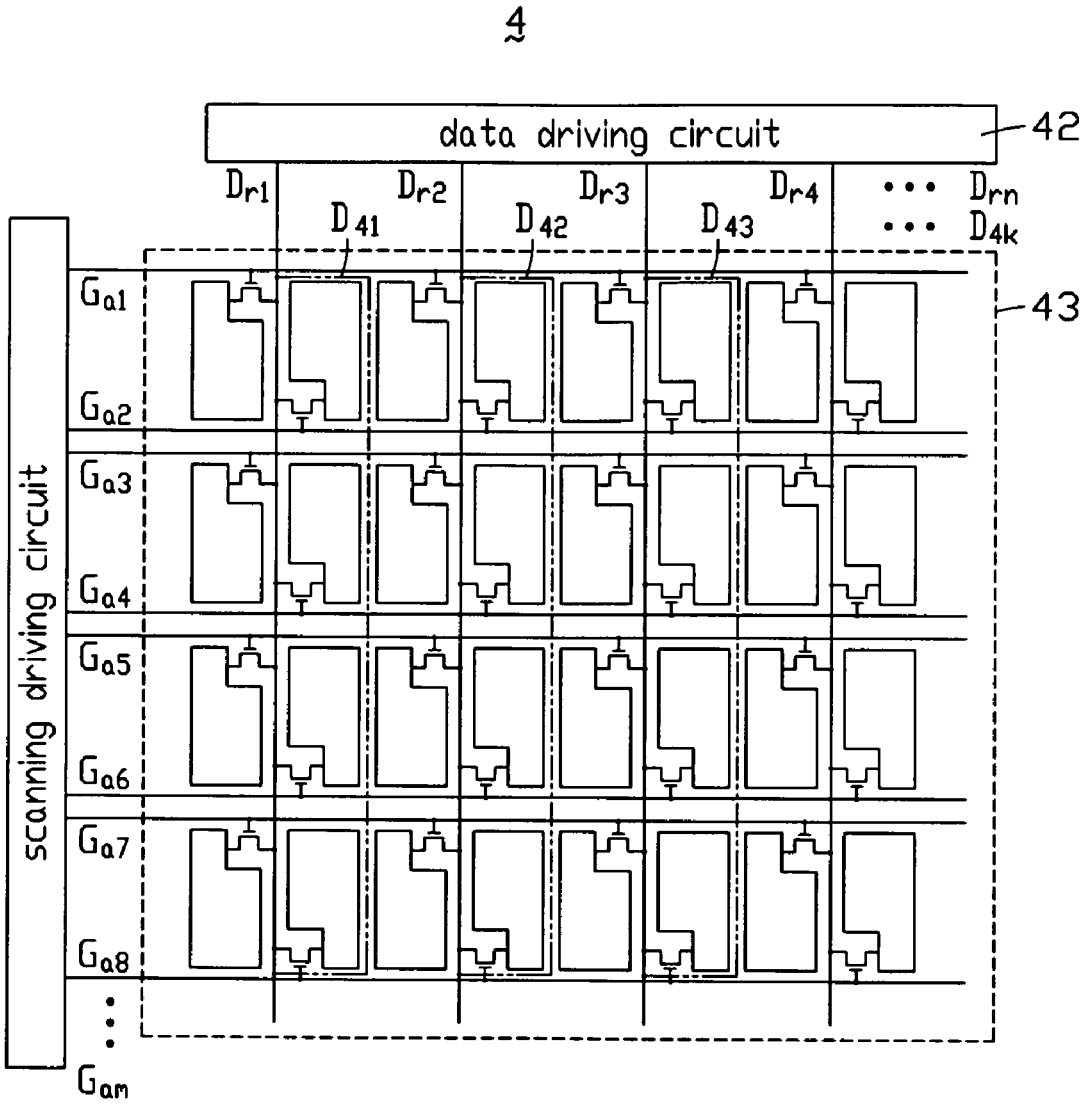
FIG. 4 is a partial circuit diagram of a third embodiment of an active matrix display device according to the disclosure.

Referring to FIG. 4, a third embodiment of an active matrix display device 4 according to the disclosure is similar to the active matrix display device 2 of the first embodiment, differing only in that, here, a plurality of dummy data lines $D_{41} \ldots D_{4k}$ are not connected to a data driving circuit 42 after connecting to each other, while being connected to a plurality of data lines $D_{r1} \ldots D_{rn}$, respectively. That is, one end of the data line Drn to which the dummy data line $D_{4k}$ is connected is adjacent to the data driving circuit 42, and the other end of the data line $D_{rn}$ to which the other end of the dummy data line $D_{4k}$ is connected is far from the data driving circuit 42. As shown in FIG. 4, the dummy data line $D_{41}$ is connected to the data line $D_{r1}$ as described, the dummy data line $D_{42}$ is similarly connected to the data line $D_{r2}$, and the dummy data line $D_{43}$ is similarly connected to $D_{r3}$. A gray scale voltage V of the dummy data line $D_{4k}$ is same as the voltage of the data line $D_{rn}$ to which it is connected.

Each of the plurality of dummy data lines $D_{41} \ldots D_{4k}$ is disposed between the two adjacent data lines and connected to one of the two adjacent data lines in configuration.

For a single pixel electrode $E_{ij}$, the voltage difference between two sides of the pixel electrode $E_{ij}$ is reduced, as is the difference in coupling capacitance. The gray scale voltage of the two adjacent pixel electrodes $E_{ij}$, influenced by the coupling capacitance, the effect of which is reduced. Thus, it is advantageous for display panel 43, by improving display quality.

Figure 5:
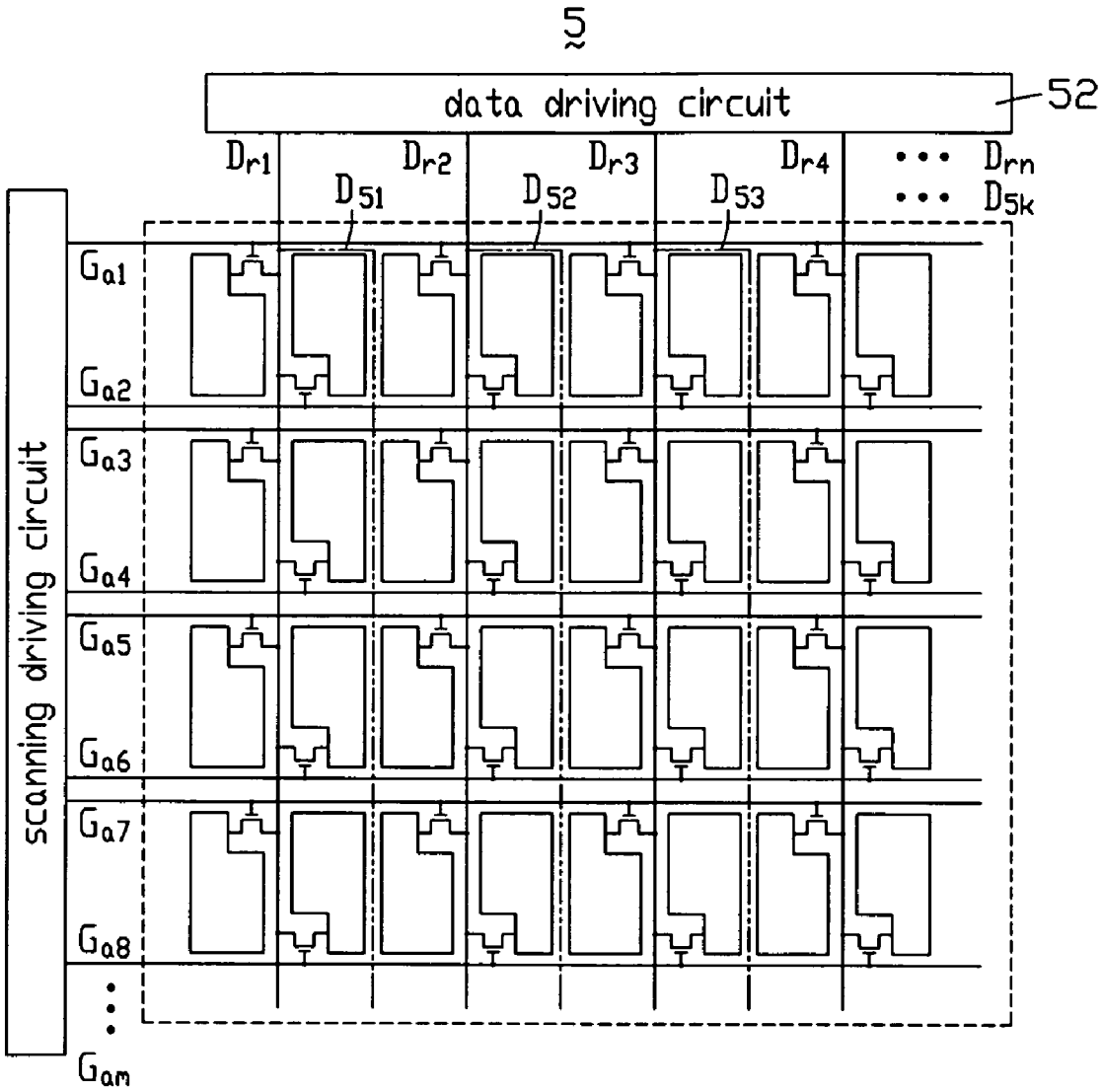
FIG. 5 is a partial circuit diagram of a fourth embodiment of an active matrix display device according to the disclosure.

Referring to FIG. 5, a fourth embodiment of an active matrix display device 5 according to the present disclosure differs from the active matrix display device 4 of the third embodiment only in that ends of a plurality of dummy data lines $D_{51} \ldots D_{5k}$, away from a data driving circuit 52, are floating.

Figure 6:
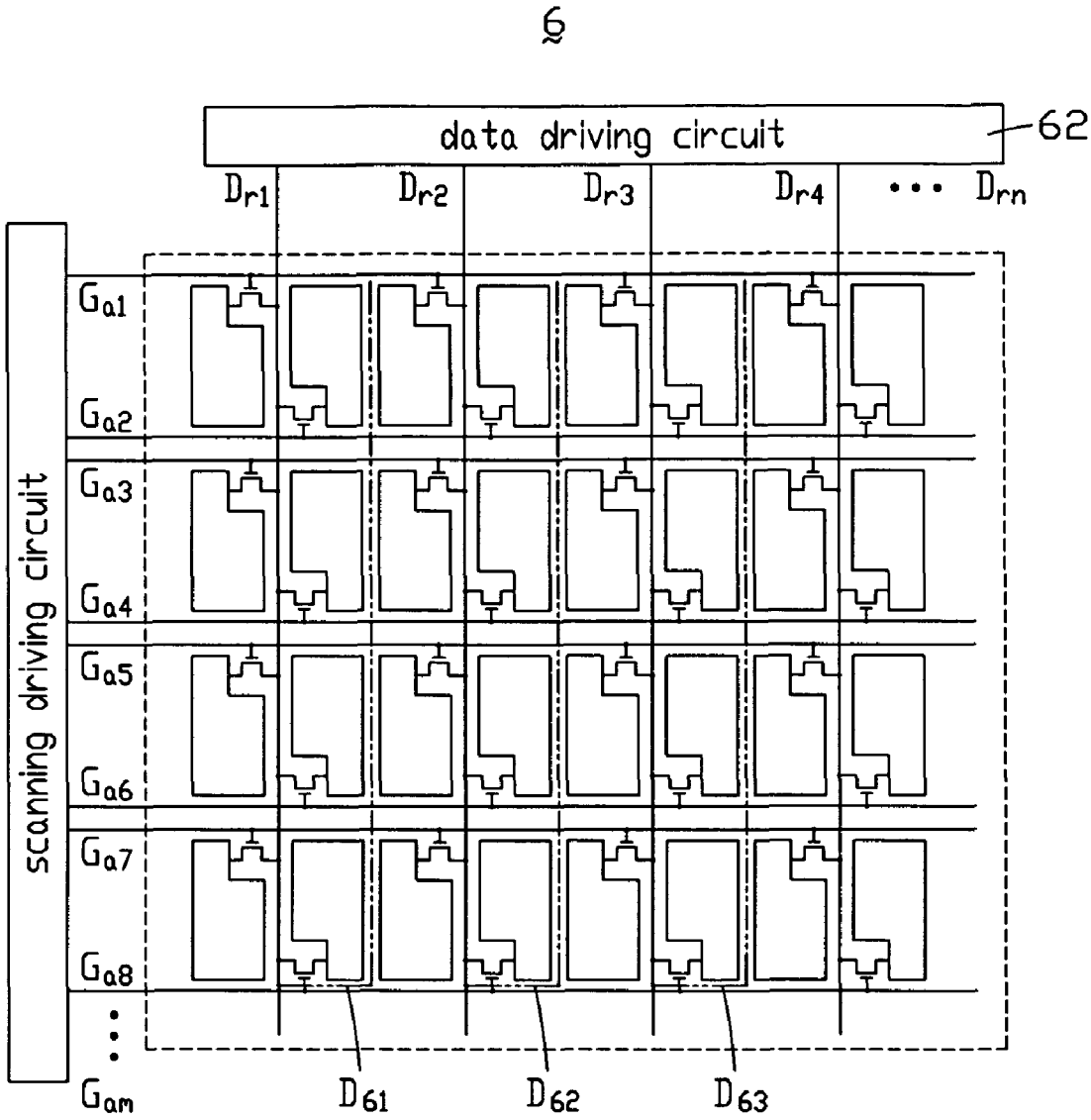
FIG. 6 is a partial circuit diagram of a fifth embodiment of an active matrix display device according to the disclosure.
Figure 7:
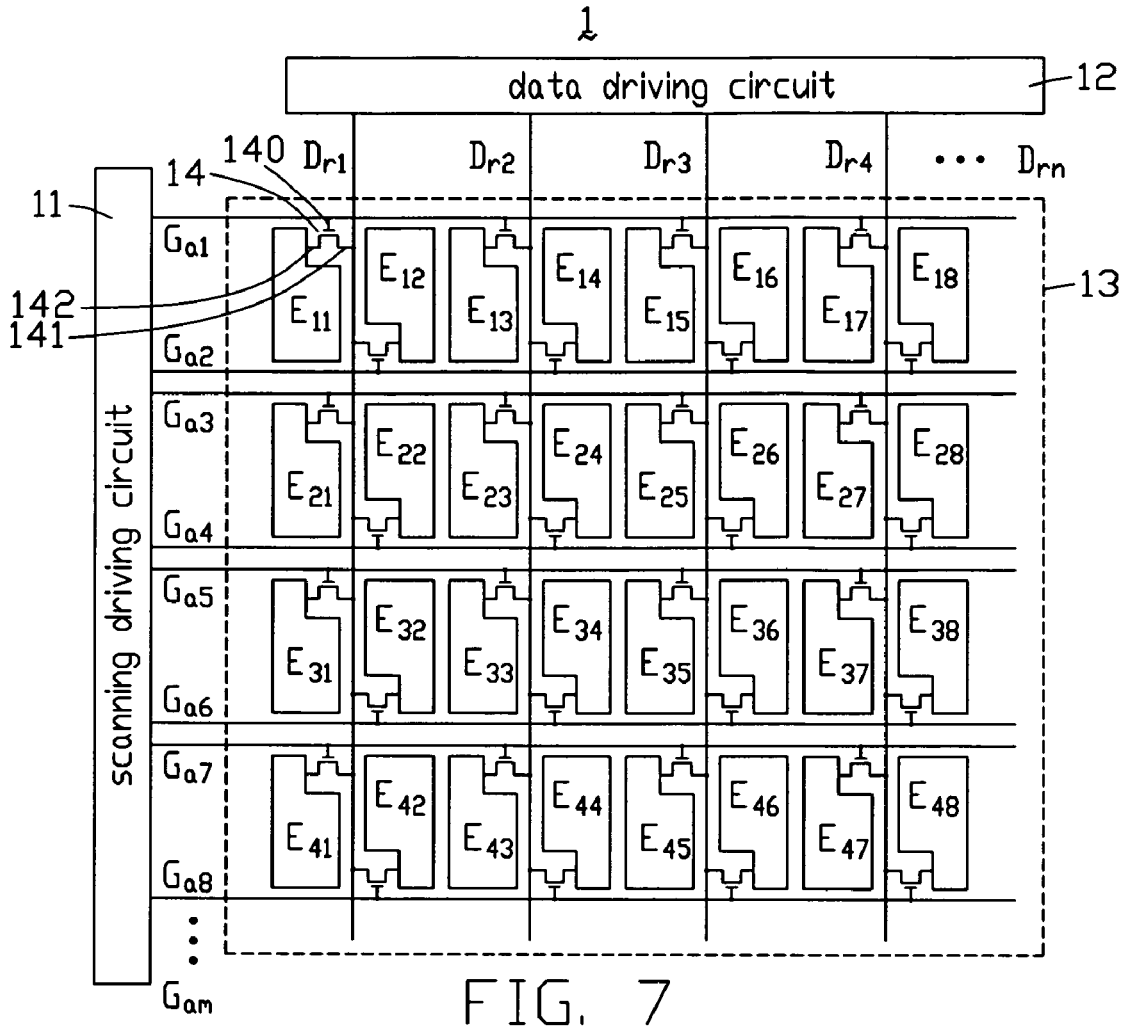
FIG. 7 (RELATED ART)
FIG. 7 is a partial circuit diagram of a conventional active matrix display device.
Figure 8:
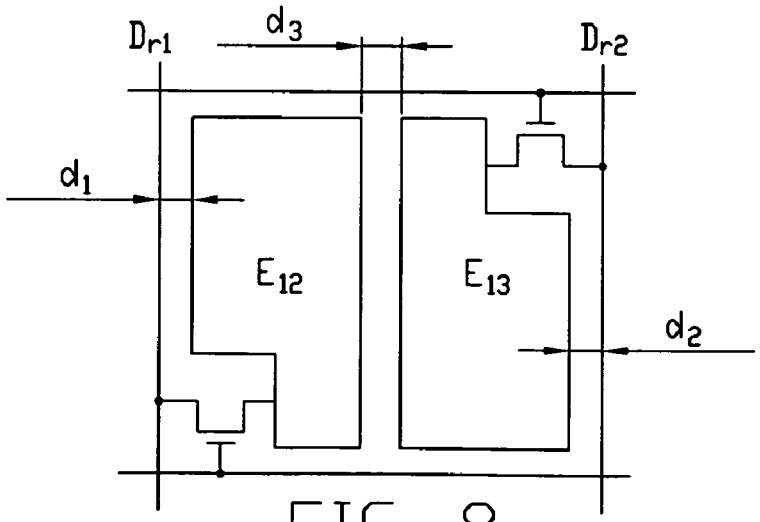
FIG. 8 (RELATED ART)
FIG. 8 is an enlarged view of part of the active matrix display device of FIG. 7.

Referring to FIG. 6, a fifth embodiment of an active matrix display device 6 according to the present disclosure differs from the active matrix display device 4 of the third embodiment only in that ends of a plurality of dummy data lines $D_{61} \ldots D_{6k}$, adjacent to a data driving circuit 62, are floating.

It is to be understood, however, that even though numerous characteristics and advantages of the present embodiments have been set out in the foregoing description, together with details of the structures and functions of the embodiments, the disclosure is illustrative only; and that changes may be made in detail, especially in matters of shape, size, and arrangement of parts within the principles of the disclosure to the full extent indicated by the broad general meaning of the terms in which the appended claims are expressed.

The invention claimed is:

1. An active matrix display device, comprising:

a display panel comprising a plurality of scanning lines extending along a horizontal axis of the display panel, a plurality of data lines extending along a vertical axis of the display panel, and two scanning lines and two data lines defining two display pixels;

a plurality of dummy data lines, wherein each of the plurality of dummy data lines is disposed between two adjacent display pixels located between the two random adjacent data lines; and a data driving circuit, configured for driving the plurality of data lines, wherein the plurality of dummy data lines comprise at least a common connective end electrically connected to the data driving circuit, the data driving circuit provides gray scale voltages for the plurality of dummy data lines;

wherein each of the plurality of data lines is connected to at least two adjacent display pixels along the horizontal axis, the at least two adjacent display pixels are driven by two corresponding scanning lines respectively, and each of the plurality of dummy data lines is disposed between two random adjacent data lines and is provided with gray scale voltage signals by a driving circuit of the display panel, to form coupling capacitances between each of the plurality of dummy data lines and two pixel electrodes of the two display pixels, wherein the polarity of the gray scale voltage for the two random adjacent data lines is opposite to the polarity of the gray scale voltage for the corresponding dummy data line at the same time.

2. The active matrix display device of claim 1, wherein the plurality of dummy data lines arranged in straight lines along the vertical axis.

3. The active matrix display device of claim 1, wherein the plurality of dummy data lines arranged in square waveforms along the vertical axis.

4. The active matrix display device of claim 1, further comprising a scanning driving circuit, wherein the plurality of scanning lines is connected to the scanning driving circuit.

5. The active matrix display device of claim 4, wherein the plurality of scanning lines perpendicularly intersect with the plurality of dummy data lines.

6. The active matrix display device of claim 5, wherein the active matrix display device is an LCD device.

7. An active matrix display device, comprising:

a display panel comprising a plurality of scanning lines extending along a horizontal axis of the display panel, a plurality of data lines extending along a vertical axis of the display panel, and two scanning lines and two data lines defining two display pixels, each of the two display pixels comprising a pixel electrode; and a plurality of dummy data lines, wherein each of the plurality of dummy data lines disposed between two adjacent data lines is electrically connected to one of the two adjacent data lines, both ends of each of the plurality of dummy data lines are connected to one of the two adjacent data lines;

wherein each of the data lines is disposed between pixel electrodes to drive adjacent display pixels, each of the data lines is connected to at least two pixels electrodes adjacent to each other along the horizontal axis, the two adjacent pixel electrodes in the horizontal axis are connected to the two scanning lines, respectively, and each of the plurality of data lines is disposed between the two pixel electrodes adjacent to each other.

8. The active matrix display device of claim 7, wherein one end of each of the plurality of dummy data lines is connected to one of the two adjacent data lines, with the other end of each of the plurality of dummy data lines floating.

9. The active matrix display device of claim 7, further comprising a scanning driving circuit, wherein the plurality of scanning lines is connected to the scanning driving circuit.

10. The active matrix display device of claim 7, further comprising a data driving circuit, wherein the plurality of data lines is connected to the data driving circuit.

11. The active matrix display device of claim 10, further comprising a scanning driving circuit, wherein the plurality of scanning lines is connected to the scanning driving circuit.

12. The active matrix display device of claim 11, wherein the plurality of scanning lines perpendicularly intersect with the plurality of data lines.

13. The active matrix display device of claim 12 wherein the active matrix display device is an LCD device.

* * * * *